US008602953B2

(12) United States Patent
Jordan

(10) Patent No.: US 8,602,953 B2
(45) Date of Patent: Dec. 10, 2013

(54) REFORMER APPARATUS HAVING INTEGRAL ERGONOMIC PURCHASE TRANSLATABLE INTO DEPLOYED AND STOWED POSITIONS

(76) Inventor: Amy Christine Jordan, Los Angeles, CA (US)

( * ) Notice: Subject to any disclaimer, the term of this patent is extended or adjusted under 35 U.S.C. 154(b) by 302 days.

(21) Appl. No.: 13/021,565

(22) Filed: Feb. 4, 2011

(65) Prior Publication Data

US 2012/0202661 A1 Aug. 9, 2012

(51) Int. Cl.
*A63B 21/00* (2006.01)

(52) U.S. Cl.
USPC ..... 482/142; 482/71; 482/72; 482/130; 482/121

(58) Field of Classification Search
USPC ..... 482/142, 121, 72, 51, 95, 96, 61
See application file for complete search history.

(56) References Cited

U.S. PATENT DOCUMENTS

| | | | | |
|---|---|---|---|---|
| 1,621,477 | A | | 3/1927 | Pilates |
| 4,067,575 | A | | 1/1978 | Ayer |
| 4,082,076 | A | | 4/1978 | Perry |
| 4,534,075 | A | | 8/1985 | Schnitzler |
| 4,768,776 | A | | 9/1988 | Giannotti |
| 4,796,881 | A | | 1/1989 | Watterson |
| 4,834,072 | A | | 5/1989 | Goodman |
| 4,867,142 | A | | 9/1989 | Jones |
| 4,921,247 | A | | 5/1990 | Sterling |
| 4,953,857 | A | | 9/1990 | Lemire |
| 4,974,832 | A | | 12/1990 | Dalebout |
| 5,007,633 | A | | 4/1991 | Lemire |
| 5,024,214 | A | | 6/1991 | Hayes |
| 5,066,005 | A | | 11/1991 | Luecke |
| D326,913 | S | | 6/1992 | Staples |
| 5,212,842 | A | | 5/1993 | Glydon |
| 5,263,913 | A | | 11/1993 | Boren |
| 5,273,508 | A | | 12/1993 | Jones |
| 5,304,109 | A | | 4/1994 | Shockley |
| 5,318,489 | A | | 6/1994 | Irwin |
| 5,338,278 | A | | 8/1994 | Endelman |
| D353,173 | S | | 12/1994 | Almeda |
| 5,411,458 | A | | 5/1995 | Giust |
| D360,796 | S | | 8/1995 | Goldado |
| D362,700 | S | | 9/1995 | Breibart et al. |
| 5,462,509 | A | | 10/1995 | Lister |
| 5,584,786 | A | | 12/1996 | Almeda |
| 5,607,381 | A | * | 3/1997 | Endelman ..... 482/142 |
| 5,645,511 | A | | 7/1997 | Le Roux et al. |
| 5,653,670 | A | | 8/1997 | Endelman |
| 5,681,249 | A | | 10/1997 | Endelman |
| 5,722,102 | A | | 3/1998 | Summers |
| 5,722,923 | A | | 3/1998 | Lui |

(Continued)

*Primary Examiner* — Jerome w Donnelly
(74) *Attorney, Agent, or Firm* — Sean D. Burdick

(57) ABSTRACT

A Pilates reformer includes a rectangular frame having two transverse ends connected by longitudinal rails, each transverse end comprising a pair of bases and an interconnecting transverse member. A planar carriage attaches to the frame by springs, and is moveable horizontally against force of the springs by means of rollers along the longitudinal rails. An ergonomic purchase confined to the frame is translatable into a stowed position for spatial efficiency, and into a deployed position that enables a user mounted on the carriage to reach the purchase, one of the transverse ends arresting the purchase when fully translated to the stowed or deployed position. The purchase may be a rotatable bench, a slidable and rotatable jump board, a vertically adjustable ballet bar, or the reformer may include a combination of these purchases.

16 Claims, 16 Drawing Sheets

(56) References Cited

U.S. PATENT DOCUMENTS

| | | | | |
|---|---|---|---|---|
| 5,755,647 | A | 5/1998 | Watnik | |
| 5,765,786 | A | 6/1998 | Gretz | |
| 5,792,033 | A | 8/1998 | Merrithew | |
| 5,795,276 | A | 8/1998 | Almeda | |
| 5,797,861 | A | 8/1998 | Port | |
| D400,386 | S | 11/1998 | Keilhauer | |
| 5,882,284 | A | 3/1999 | Cayne | |
| 5,897,472 | A | 4/1999 | Thulasingam | |
| 5,906,564 | A | 5/1999 | Jacobsen | |
| 5,918,837 | A | 7/1999 | Vicain | |
| 5,925,003 | A | 7/1999 | Vincent et al. | |
| D430,627 | S | 9/2000 | Bergman | |
| 6,120,425 | A | 9/2000 | Endelman | |
| 6,186,929 | B1 | 2/2001 | Endelman et al. | |
| 6,338,704 | B1 | 1/2002 | Endelman | |
| 6,371,895 | B1 | 4/2002 | Endelman et al. | |
| 6,527,685 | B2 | 3/2003 | Endelman et al. | |
| 6,595,902 | B1 | 7/2003 | Savage et al. | |
| 6,634,997 | B2 | 10/2003 | Breibart et al. | |
| 6,634,999 | B2 | 10/2003 | Herbst | |
| 6,651,281 | B1 | 11/2003 | Figiel | |
| 6,705,797 | B1 | 3/2004 | Wada | |
| 6,725,481 | B1 | 4/2004 | Marshall | |
| 6,733,428 | B2 | 5/2004 | List | |
| 6,755,771 | B2 | 6/2004 | Wallerstein | |
| 6,805,409 | B2 | 10/2004 | Parker | |
| 6,835,169 | B2 | 12/2004 | Tamaribuchi | |
| 6,837,838 | B2 | 1/2005 | List | |
| 6,892,810 | B2 | 5/2005 | Austbo et al. | |
| 6,916,279 | B2 | 7/2005 | Endelman | |
| 6,926,650 | B2 | 8/2005 | Endelman et al. | |
| 6,971,976 | B2 | 12/2005 | Endelman et al. | |
| 6,988,979 | B1 | 1/2006 | Trainor | |
| 7,029,425 | B2 | 4/2006 | Krull | |
| D526,033 | S | 8/2006 | Van Straaten et al. | |
| 7,104,937 | B2 | 9/2006 | Arbuckle et al. | |
| 7,125,369 | B2 | 10/2006 | Endelman | |
| 7,137,937 | B2 | 11/2006 | Croft | |
| 7,160,232 | B2 | 1/2007 | Barnard et al. | |
| 7,163,498 | B1 | 1/2007 | Abelbeck | |
| 7,163,500 | B2 | 1/2007 | Endelman et al. | |
| 7,179,207 | B2 | 2/2007 | Gerschefske | |
| 7,203,983 | B1 | 4/2007 | Reeves et al. | |
| 7,270,628 | B2 | 9/2007 | Campanaro et al. | |
| 7,288,053 | B2 | 10/2007 | Endelman et al. | |
| 7,288,054 | B2 | 10/2007 | Endelman et al. | |
| D555,741 | S | 11/2007 | Wachtfogel et al. | |
| 7,294,098 | B2 | 11/2007 | Barnard et al. | |
| 7,346,935 | B1 | 3/2008 | Patterson | |
| 7,452,313 | B2 | 11/2008 | Endelman | |
| 7,465,261 | B2 * | 12/2008 | Barnard et al. | 482/142 |
| 7,503,880 | B2 | 3/2009 | Campanaro et al. | |
| 7,524,273 | B1 | 4/2009 | Martin | |
| 7,563,217 | B2 | 7/2009 | Endelman | |
| 7,604,579 | B2 | 10/2009 | Isacowitz et al. | |
| 7,608,030 | B2 | 10/2009 | Splane | |
| 7,641,604 | B2 | 1/2010 | Blount | |
| 7,682,298 | B2 | 3/2010 | Croft | |
| 7,691,039 | B2 | 4/2010 | Isacowitz et al. | |
| 7,766,801 | B2 | 8/2010 | Campanaro et al. | |
| 7,771,320 | B2 | 8/2010 | Riley et al. | |
| 7,771,328 | B2 | 8/2010 | Gerschefske | |
| 7,794,378 | B2 | 9/2010 | Splane, Jr. et al. | |
| 7,803,095 | B1 | 9/2010 | LaGree | |
| 7,806,805 | B2 | 10/2010 | Barufka et al. | |
| 7,806,815 | B2 | 10/2010 | Fernandez et al. | |
| 7,824,319 | B2 | 11/2010 | Carlesimo et al. | |
| 7,833,139 | B1 | 11/2010 | Endelman et al. | |
| 7,857,736 | B2 * | 12/2010 | Merrithew et al. | 482/121 |
| 2003/0078143 | A1 | 4/2003 | Breibart et al. | |
| 2004/0033873 | A1 | 2/2004 | Van Straaten | |
| 2004/0142801 | A1 | 7/2004 | Lin | |
| 2004/0226096 | A1 | 11/2004 | Davis | |
| 2006/0040811 | A1 | 2/2006 | Foster | |
| 2006/0116262 | A1 | 6/2006 | Pandozy et al. | |
| 2008/0171643 | A1 * | 7/2008 | Baudhuin | 482/148 |
| 2008/0248935 | A1 * | 10/2008 | Solow et al. | 482/142 |

* cited by examiner

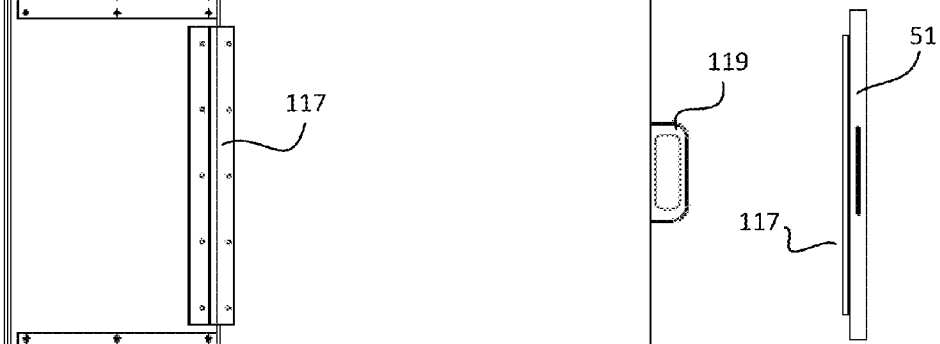
FIG. 27
FIG. 26
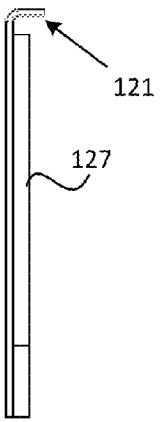
FIG. 29
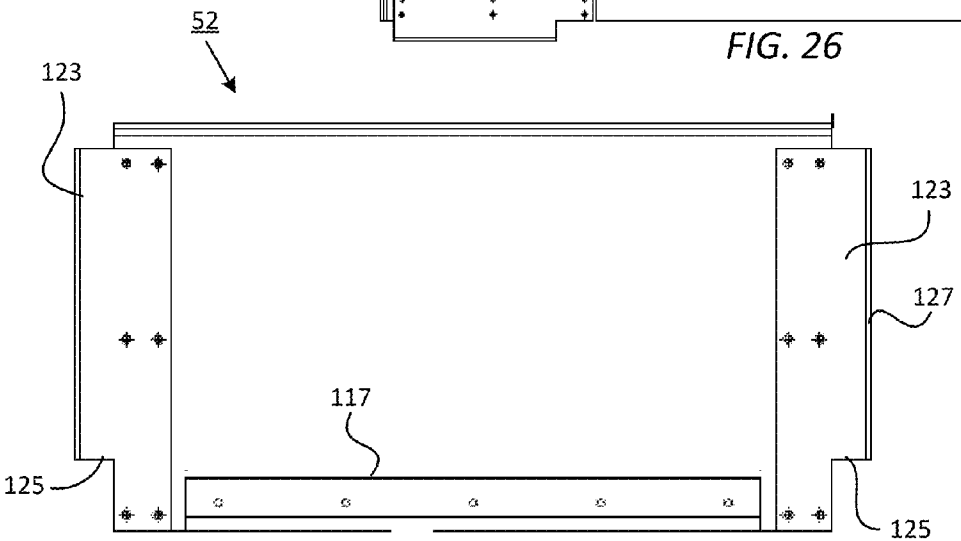
FIG. 28

REFORMER APPARATUS HAVING INTEGRAL ERGONOMIC PURCHASE TRANSLATABLE INTO DEPLOYED AND STOWED POSITIONS

BACKGROUND OF THE INVENTION

1. Field of the Invention

The present invention relates generally to physical exercise apparatus, and more specifically to a Pilates-type reformer having built-in translatable props that may be deployed on the reformer to facilitate exercise and stowed within the reformer for spatial efficiency.

2. Description of Related Art

The Pilates method has been a popular style of exercise for many decades. Pilates prescribes precise forms of physical exercise that seek to increase strength, flexibility, and muscular control. Pilates exercise is primarily based on resistance training, and is facilitated through the use of various props and customized apparatus commonly referred to as "Pilates machines".

The Pilates method dates to U.S. Pat. No. 1,621,477 granted to Joseph Pilates on Mar. 15, 1927. The apparatus disclosed in the '477 patent is the earliest example of a "reformer"—a term that, in the field of exercise machines, refers to an apparatus comprising a stationary frame that supports a carriage moveable horizontally by means of rollers along longitudinal rails mounted to the frame. In the original reformer, the carriage was connected by cables through a pulley system to a weight. The frame allowed a user to exercise while lying on a top platform of the carriage by pushing or pulling the carriage, using arm or leg movements, against the gravitational force of the weights. Relaxation would return the carriage to its original position. Later improvements on the basic Pilates design substitute tension springs for the weights, or use a combination of springs and weights.

Over the years, improvements on the original design of the Pilates reformer have primarily involved changes to or additions of accessories, and have not introduced innovations that depart from the central concept of the carriage assembly sliding horizontally against the tension of springs. Mechanical features have been added or augmented for purposes such as improving the rail & roller design, facilitating maintenance, and adding ergonomic components such as vertical jump boards and headrests. Many examples of these types of improvements may be found in the published references disclosed in the prosecution history of this patent.

In many cases, the accessories are used as props in conjunction with reformer movement when performing certain types of exercise. For example, a vertical platform, i.e. a board or other planar surface extending in a direction normal to the horizontal surface of the carriage, can be placed at one end of the reformer to afford the user a purchase or hold to help stabilize the body while the user moves the carriage to and fro through alternating flexure and relaxation of leg or arm muscles. These types of accessories must be installed when needed, usually by bolting them to the frame of the reformer to ensure stability. When reconfiguring the reformer for another exercise, the accessory must be uninstalled and set aside.

Other examples of accessories include chairs, ballet bars, foot bars, and handles, all of which, in prior art reformer designs, comprise separate components that must be installed when needed and uninstalled when reconfiguring the reformer for another exercise. These installations require that the user interrupt her exercise regimen, locate tools and fastening hardware, and spend time reconfiguring the reformer. Related costs, complexity, and spatial concerns detract from practicality.

As a result, it has become popular in recent years for students to practice the Pilates method with a motivational trainer in group sessions. Pilates classes allow students to enjoy the benefits of Pilates machines without the burden of machine ownership. The classes provide a social atmosphere in which members can exercise alongside classmates, each using their own machine under supervision of a professional trainer, in sessions that last around forty-five minutes to an hour. A downside to the group session may be seen, however, whenever the Pilates machines need to be reconfigured for a particular group exercise. Many users require assistance reconfiguring the machines with the proper accessories, especially novices who are unfamiliar with the equipment. The trainer discovers that valuable time is consumed as she moves from machine to machine, assisting with installations, while experienced users patiently (or impatiently) await the starting signal.

Apparently there is a need for further innovations in the design of Pilates machines to address the foregoing problems, especially the need to allow users to transition quickly from one exercise to another.

SUMMARY OF THE INVENTION

The present invention improves upon the conventional design of a Pilates reformer that includes a rectangular frame and a planar carriage attached to the frame by springs so that the carriage may be moved horizontally against force of the springs by rollers along longitudinal rails that are mounted to the frame. The improvement generally comprises an ergonomic purchase that is integral to the reformer and that is translatable into both deployed and stowed positions. With the purchase translated to the stowed position the reformer is collapsed into a smaller overall volume for spatial efficiency for storage, transport, or during periods of nonuse. With the purchase translated into the deployed position a user mounted on the carriage may reach the purchase with a part of her body to stabilize herself during exercise. The integral design of the ergonomic purchase allows it to be translated quickly by hand without the need for tools or hardware.

In one embodiment, a conventional reformer design is enhanced with an integral ergonomic purchase translatable into deployed and stowed positions, wherein the ergonomic purchase comprises a rotatable bench rotatably confined to one end of the reformer. The rotatable bench includes a first planar surface, and a second planar surface forming a right angle with respect to the first planar surface. The reformer is configured so that when the bench is translated by rotation to the stowed position, the first planar surface lies substantially within a plane parallel to the carriage at a first elevation. The reformer is further configured so that when the bench is translated by rotation to the deployed position, the first planar surface lies substantially within a plane normal to the carriage and the second planar surface lies substantially in a plane parallel to the carriage at a second elevation. Therefore the bench when stowed provides a seat at the carriage level. When deployed, the bench may provide a seat at a level other than carriage level and a push-off surface that faces the carriage.

In another embodiment, a conventional reformer design is enhanced with an integral ergonomic purchase translatable into deployed and stowed positions, wherein the ergonomic purchase comprises a slidable and rotatable jump board confined to one end of the reformer. A sliding guide may be hinged to the slidable and rotatable jump board so that the jump board may be rotated to lie substantially within the same plane as the sliding guide, to facilitate sliding the jump board to its storage location within the reformer. The jump board may then be translated to the deployed position by withdrawing the jump board and sliding guide and rotating the jump board to an angle greater than zero with respect to the sliding guide. This configuration allows the jump board to be stored beneath a portion of the reformer when not in use, and when needed, drawn out and rotated to a vertical position to provide a push-off surface that faces the carriage.

In another embodiment, a conventional reformer design is enhanced with an integral ergonomic purchase translatable into deployed and stowed positions, wherein the ergonomic purchase comprises a vertically adjustable ballet bar confined at one end of the reformer. The ballet bar may include a substantially horizontal crossbar vertically supported by telescoping arms. When the ballet bar is translated to the stowed position, the telescoping arms may be retracted within the frame of the reformer to lower the crossbar to an elevation substantially level with the carriage. When the ballet bar is translated to the deployed position, the telescoping arms may be extended beyond the frame to raise the crossbar to an elevation substantially higher than the carriage. In one embodiment, the ballet bar may be maintained at any position within its telescoping range by friction between cooperating telescoping sections.

In another embodiment, the frame of the reformer is improved to accommodate or arrest the integral translatable ergonomic purchase. In this version, a Pilates reformer includes a rectangular frame having two transverse ends connected by longitudinal rails, wherein each transverse end includes a pair of bases and an interconnecting transverse member. A planar carriage attaches to the frame by springs, and is moveable horizontally against force of the springs by means of rollers along the longitudinal rails. An ergonomic purchase confined to the frame is translatable into a stowed position for spatial efficiency, and into a deployed position that enables a user mounted on the carriage to reach the purchase. The reformer is configured so that one of the transverse ends accommodates or arrests the purchase when fully translated to the stowed or deployed position. In different embodiments the purchase may be a rotatable bench, a slidable and rotatable jump board, or a vertically adjustable ballet bar, or the reformer may include any combination of the bench, jump board, and ballet bar.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions shown are exemplary only. In the drawings, like reference numerals may designate like parts throughout the different views, wherein:

FIG. 26 is a top view of one embodiment of an ergonomic purchase in the form of a slidable and rotatable jump board hinged to a sliding guide according to the invention.

FIG. 27 shows a front end view of the jump board of FIG. 26.

FIG. 28 shows a magnified top view of the sliding guide of FIG. 26.

FIG. 29 shows a side view of the sliding guide of FIG. 28.

DETAILED DESCRIPTION OF THE INVENTION

Figure 1:
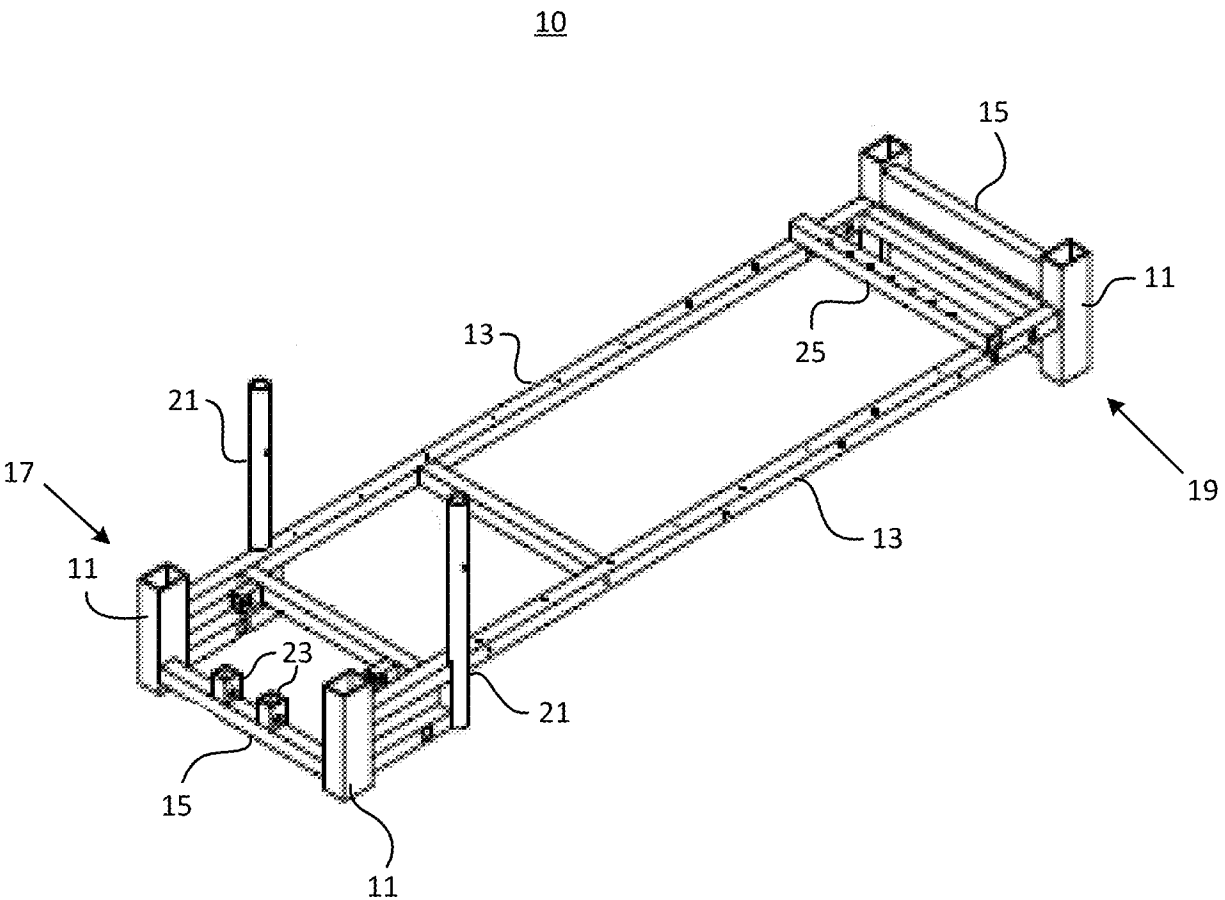
FIG. 1 is perspective view of a rectangular frame for a reformer according to one embodiment of the invention.

The following disclosure presents an exemplary embodiment for a reformer apparatus having an ergonomic purchase that is integral to the reformer and that is translatable into both deployed and stowed positions. An ergonomic purchase according to the invention, and variations thereof reflective of the invention, enhances the conventional design of a Pilates reformer. Herein, the conventional design means prior art construction consisting of a rectangular frame and a planar carriage attached to the frame by springs that enables the carriage to be moved horizontally against the force of the springs by rollers along longitudinal rails that are mounted to the frame. Advantages realized by the inventive ergonomic purchase include simplicity of set-up and spatial efficiency. These advantages will be more fully understood after a thorough reading of the disclosure.

The term "ergonomic purchase" as used herein means a surface designed for contacting by a human engaged in exercise, such as by grasping, holding, or pressing the hand, foot, or other part of the body against the surface while mounted on the moving carriage, to achieve stability or to establish leverage for pushing or pulling the carriage by muscle flexure and friction at the point of contact. Contemporary dictionary definitions of the term purchase used in this mechanical sense may apply equally to the use of the term throughout this disclosure. For example, purchase may denote both a surface providing stabilizing contact, and a point of frictional contact achieved on the surface. In embodiments of the invention herein, an ergonomic purchase is reachable by a user mounted on the moving carriage, and so the carriage itself is excluded from the definition of ergonomic purchase.

The term "integral" as used herein when modifying ergonomic purchase means that the component comprising the ergonomic purchase is confined to the reformer, or installed onto the reformer when the reformer is fully assembled, such that it cannot be removed from the reformer assembly without the use of tools or without disengaging one or more fasteners or disconnecting a fastening means (such as a threaded engagement) that is holding or confining the component to the reformer during normal operation. Contemporary dictionary definitions of the term integral consistent with this mechanical sense may apply equally to the use of the term throughout this disclosure.

The term "translate" (and its derivatives, such as "translation" and "translatable") is used herein in the sense that means physical movement of one component with respect to another, such as by linear motion or by rotation about an axis. Contemporary dictionary definitions of the term translate consistent with this mechanical sense may apply equally to the use of the term throughout this disclosure.

The term "deployed" as used herein means a state or position of a component of the reformer in which the component is intended to be used by a user exercising by means of the reformer. For example, an ergonomic purchase in a deployed condition has been translated, or moved and possibly fixed into a position on the reformer, that allows it to be reached for purchase by a user mounted exercising with the aid of the reformer. Contemporary dictionary definitions of the term deployed used in this mechanical sense may apply equally to the use of the term throughout this disclosure.

The term "stowed" as used herein means a state or position of a component of the reformer which collapses the overall volume of the reformer to a minimum, insofar as the volume may be affected by the component. In other words, it is the position of the component that will allow the reformer to be packaged within the smallest possible container, or the position of the component which renders the reformer most suitable for storage according to the manufacturer. A component translated to a stowed position, in practical terms, is no longer reachable for the same purchase achieved by a user in the position on the reformer from which she gained the purchase when the component was deployed. Contemporary dictionary definitions of the term stowed used in this mechanical sense may apply equally to the use of the term throughout this disclosure.

With reference now to FIG. 1, there is shown a perspective view of one embodiment of a rectangular frame 10 for a reformer apparatus according to the invention. The frame 10 includes four base members or bases 11 disposed in rectangular relation, that is, at each of the four corners of the rectangle defined by the frame. Longitudinal rails 13 and transverse members 15 extend between the bases 11 as shown. At either end of the frame, a pair bases 11 and a transverse member 15 combine to form a transverse end. In this embodiment, there is a front transverse end 19 and an aft transverse end 17. Optional cylindrical tubing 21 may be welded to the frame 10 near the aft end to accommodate vertically extendable handles, one per side. Additional parts of the frame may include brackets 23 for mounting an ergonomic purchase such as a rotatable bench, a spring mount 25 for connecting a carriage to the frame by multiple springs, and additional transverse members that serve to strengthen the frame or arrest the translation of an ergonomic purchase.

In terms of dimensions, the frame 10 may be scaled up or down according to market demand. For purposes of illustration only, one exemplary size for the frame is 108.0 in.×29.0 in., with the rails 13 displaced about 7.0 to 8.0 in. above the ground. The components of frame 10 are preferably constructed from metal such as 2×2 in. stainless steel or plated carbon steel hollow square tubing with 0.19 in. wall thickness. Larger size rectangular tubing may be used to construct the bases 11. Tubing 21 may be constructed from 2.0 in. round, 0.19 in. wall seamless steel tubing. Carbon steel may be preferred for some parts of the frame that rely on magnetic properties for fixing the position of a moving part. Wood construction is also possible as an alternative material for use in forming the frame components, as well as the many other metal and plastic parts of the reformer described herein.

Figure 2:
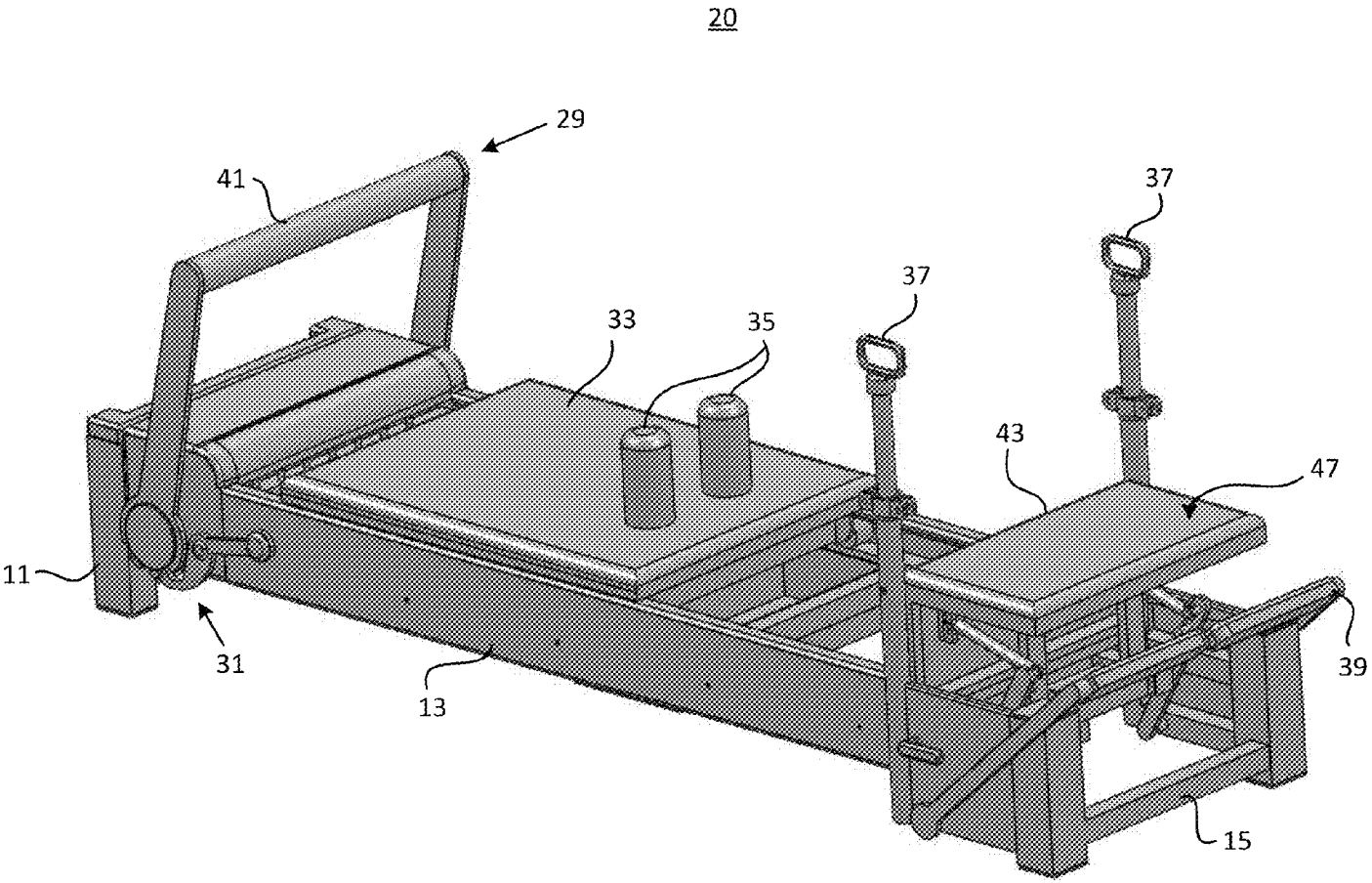
FIG. 2 is an aft end perspective view of one embodiment of a reformer according to the invention showing a rotatable bench translated to a deployed position.

Turning now to FIG. 2, an aft end perspective view is shown for one embodiment of a complete reformer 20 according to the present invention. Reformer 20 may be constructed on a frame similar to frame 10. The complete reformer 20 features many accessories. Beginning at the front end and moving aft, the reformer includes a horizontal rotatable foot bar 29, a rotatably adjustable locking means 31, a slidable carriage 33, shoulder block posts 35, vertically extendable handles 37, and aft foot pedals 39. These components may be constructed from metal materials or a strong thermoplastic such as polyoxymethylene, a.k.a. POM or Dupont Delrin. Upholstery or foam padding may also be added to components such as the top surface of carriage 33 and the outer surface of crossbar 41 of the foot pedal assembly that come into contact with a user.

The reformer 20 is also equipped with an integral ergonomic purchase according to the invention in the form of a rotatable bench 43, which in this perspective has been translated to a deployed position. Rotatable bench 43 may be constructed as a right-angle bench that provides two planar surfaces connected in a perpendicular relation, as shown. In the deployed position, the bench 43 has one planar surface 45 (FIG. 3) lying substantially within a plane normal to the carriage 33 and a second planar surface 47 lying substantially in a plane parallel to the carriage 33 at an elevation that is higher than the plane of the carriage.

Figure 3:
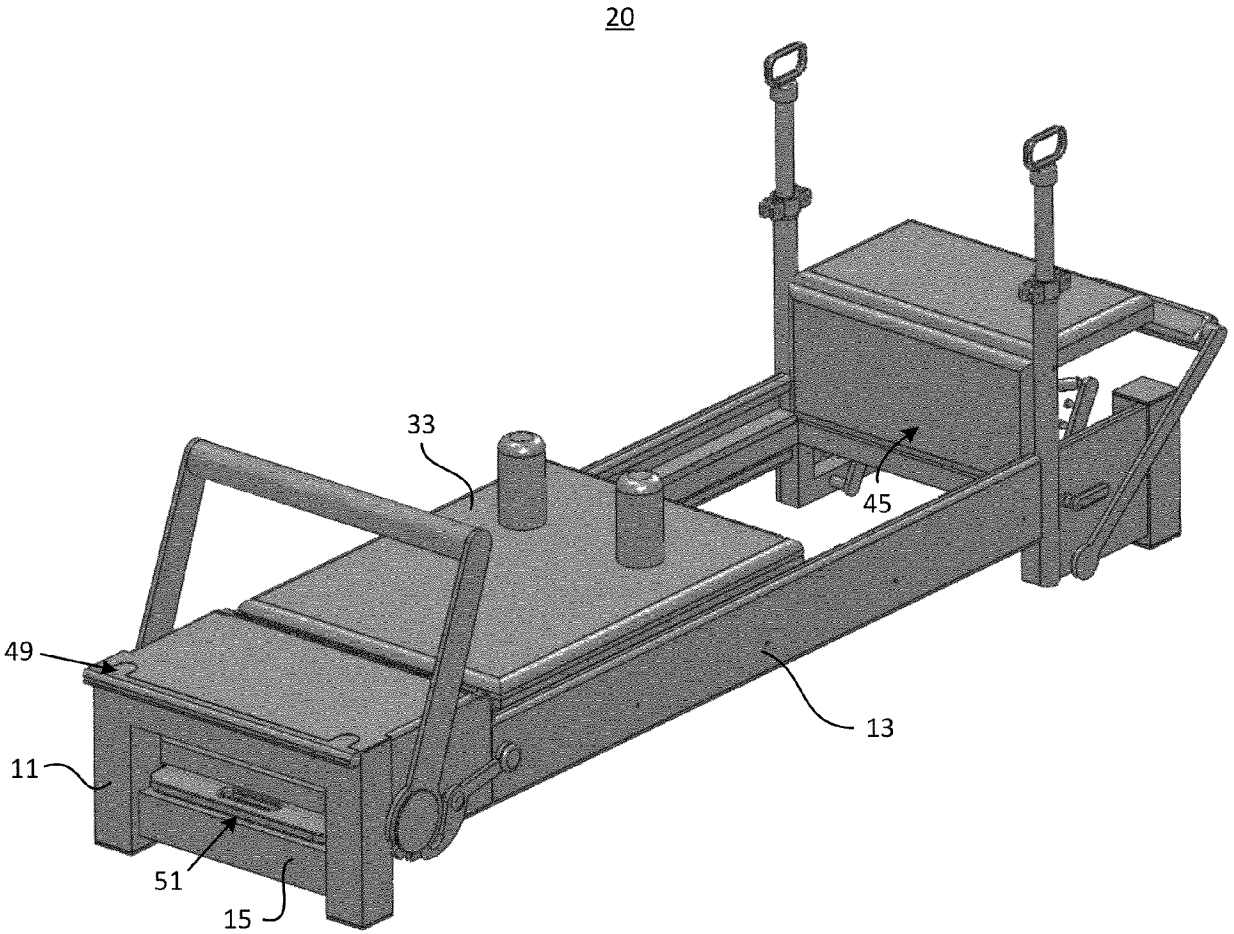
FIG. 3 is a top perspective view of the reformer of FIG. 2 showing translatable purchases—jump board, and ballet bar—in stowed positions.

FIG. 3 shows a top perspective view of the reformer 20. This view also shows the bench 43 translated to the deployed position. From this perspective, the first planar surface 45 of the rotatable bench can be seen facing the carriage 33. The top end of a ballet bar 49 in its stowed position can be seen flush with a top surface of the reformer 20 at the front end. This view also shows a third embodiment of an ergonomic purchase—a slidable and rotatable jump board 51. The jump board 51 is in its stowed position, wherein most of the jump board lies partially beneath the carriage 33 and remains hidden from sight. In this position only the extreme end of the jump board visible.

Figure 4:
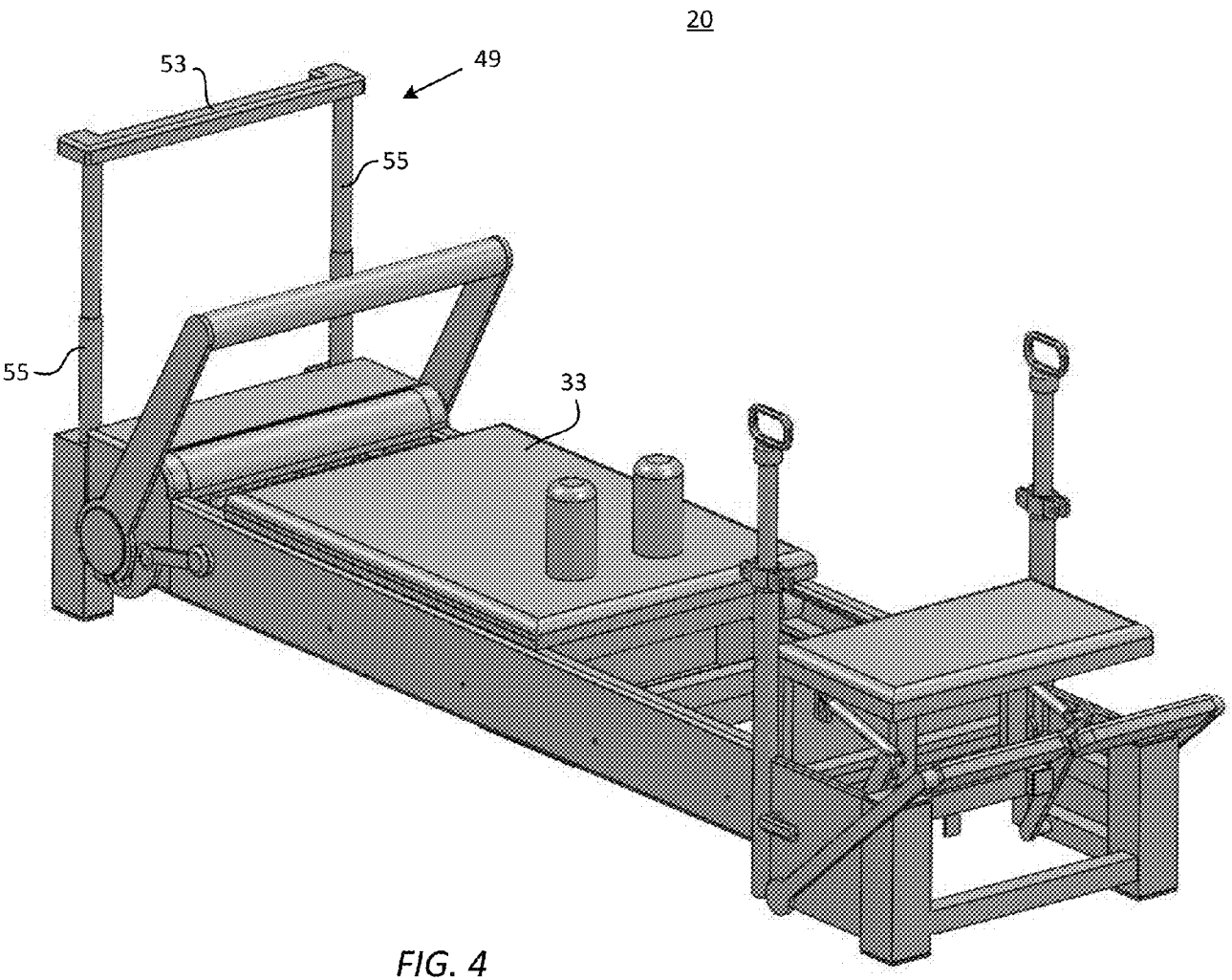
FIG. 4 is an aft end perspective view of the reformer of FIG. 2 showing a ballet bar vertically extended to a deployed position.

FIG. 4 illustrates an aft end perspective view of reformer 20, in which the another embodiment of an ergonomic purchase, the ballet bar 49, has been translated to a deployed position. In this embodiment, ballet bar 49 is an assembly that includes a substantially horizontal crossbar 53 that is vertically supported by two telescoping arms 55, as will be described in greater detail with reference to FIGS. 22-24. When the ballet bar 49 is translated to the deployed position, the telescoping arms 55 are extended beyond the frame 10 to raise the crossbar 53 to an elevation substantially higher than the carriage 33. When the ballet bar 49 is translated to the stowed position, the telescoping arms 55 are retracted within the front transverse end 19 of frame 10 to lower the crossbar to an elevation substantially level with the carriage.

Figure 5:
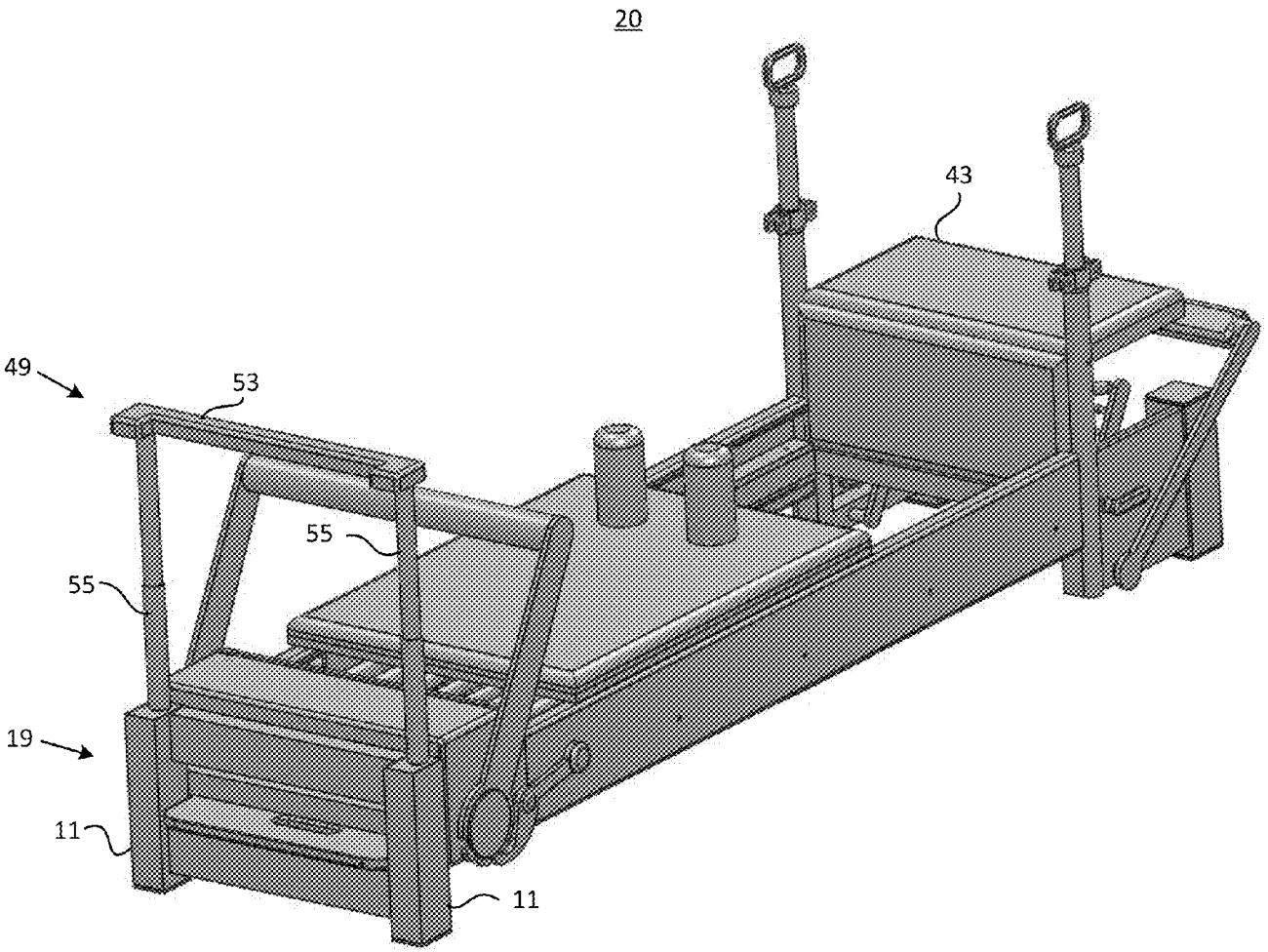
FIG. 5 is a front end perspective view of the reformer of FIG. 2 showing the rotatable bench and ballet bar in deployed positions.

FIG. 5 provides a front end perspective view of reformer 20 that shows the rotatable bench 43 and the vertically extendable ballet bar 49 in deployed positions. This view illustrates each of the telescoping arms 55 extended upward from a storage location within a base member 11. In this embodiment, the base members 11 of the front transverse end 19 serve to support the ballet bar 49 in the deployed position. In the stowed position, each of the bases 11 provides a housing into which telescoping arms 55 may be fully retracted. In the stowed position, with the arms 55 fully retracted and the cross bar 53 flush with a top surface of the reformer, the ballet bar 49 may be considered to be at least partially retracted.

Figure 6:
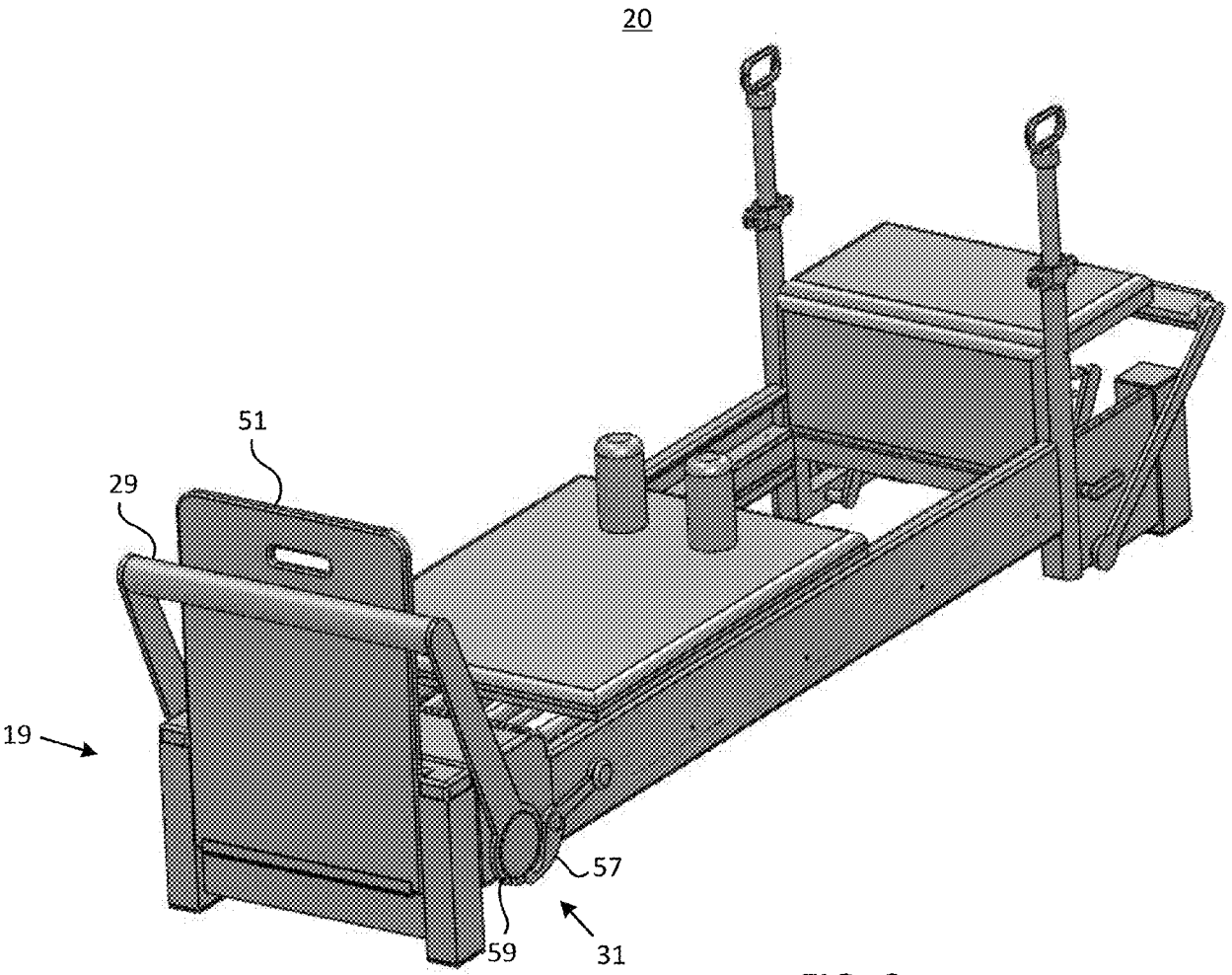
FIG. 6 is a front end perspective view of the reformer of FIG. 2 showing a slidable and rotatable jump board secured in a deployed position by a rotatable horizontal foot bar.

FIG. 6 illustrates another front end perspective view of reformer 20. This view shows the slidable and rotatable jump board 51 in a deployed position. Here, the jump board 51 is secured in its deployed position by pressing it between the front transverse end 19 and the rotatable horizontal foot bar 29, and locking the jump board into that position by means of the rotatably adjustable locking means 31. In one embodiment, the locking means 31 includes a spring-loaded mechanical pawl 57 that may be removably locked within any of multiple notches presented by a cooperating rotary latch 59. Alternative rotatably adjustable locking means may be implemented without departing from the scope of the invention.

Figure 7:
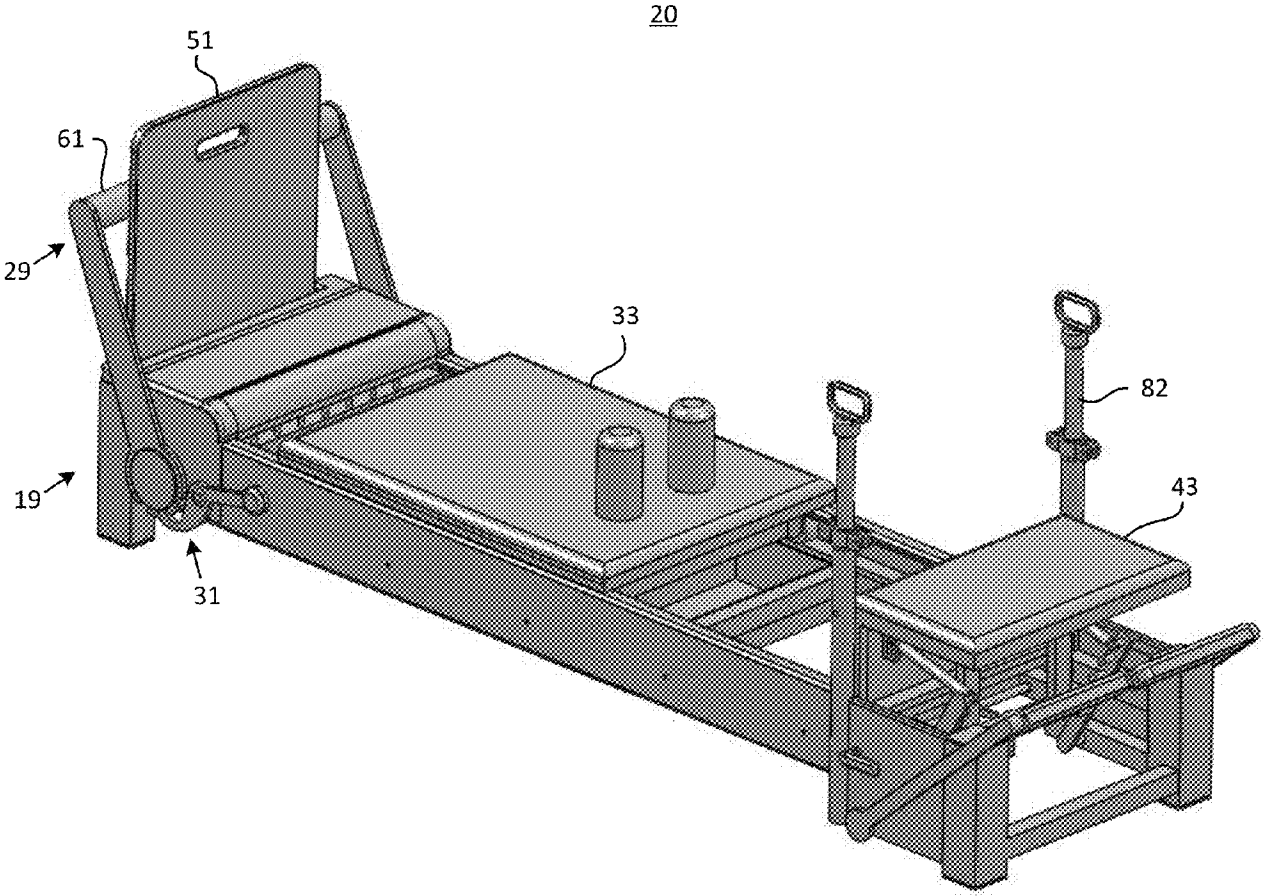
FIG. 7 is an aft end perspective view of the reformer of FIG. 2 showing the jump board and the rotatable bench in deployed positions.

FIG. 7 provides an aft end perspective view of the reformer 20 showing the slidable and rotatable jump board 51 and the rotatable bench 43 in deployed positions. In this embodiment, to secure the jump board 51 in its deployed position, the locking means 31 that arrests foot bar 29 must first be unlocked so that the foot bar is free to rotate. The horizontal member 61 of foot bar 29 may then be rotated away from the carriage 33 and further out from the front end of the reformer, to a position lower than the plane defined by the jump board and sliding guide (FIGS. 3 and 26). The jump board 51 may then be withdrawn from the front end of the reformer until the sliding guide reaches its furthest outward displacement, which places a hinged portion of the jump board beyond the front transverse end 19, and allows the jump board to be rotated toward the carriage to its deployed position while the sliding board remains stationary. Then, the foot bar 29 may be rotated manually in the same direction until horizontal member 61 contacts the jump board and firmly presses the jump board against the outer surface of front transverse end 19. In this embodiment, as the foot bar 29 is rotated toward the carriage, locking means 31 acts like a ratchet as the pawl 57 engages and disengages each slot in rotary latch 59 by action of the spring as the latch 59 rotates, until the foot bar achieves its desired position. More detailed examples of the mechanical means for translating each of the ergonomic purchases from their stowed to their deployed positions are provided below.

Figure 8:
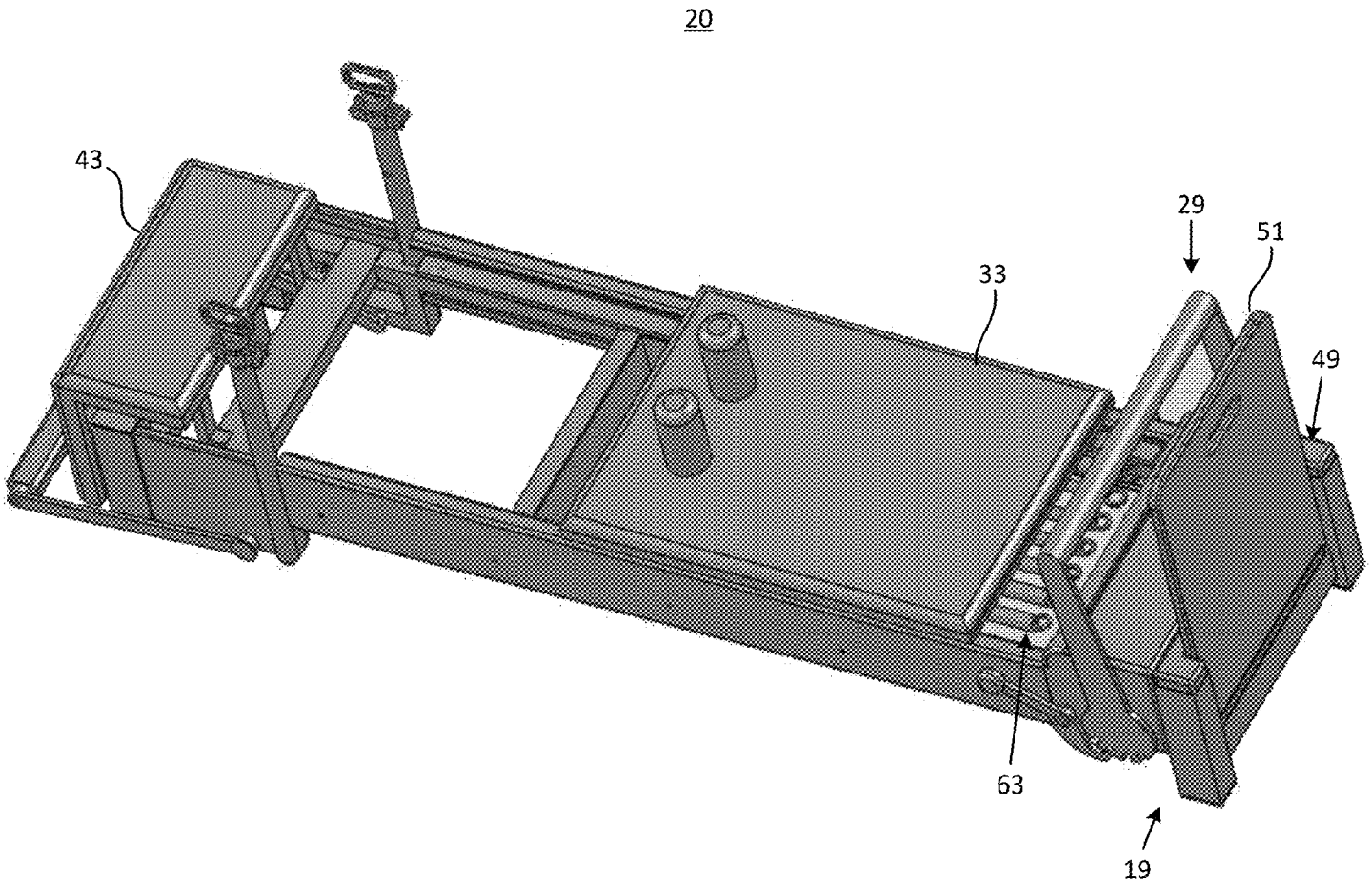
FIG. 8 is a top perspective view of the reformer of FIG. 2 seen from an opposite side, showing the rotating bench in a stowed position and the jump board in an unsecured deployed position.

FIG. 8 shows a top perspective view of the reformer 20 from a side opposite that of the perspective of FIG. 7. In this view, the rotating bench 43 and the ballet bar 49 are stowed, while the jump board 51 is in a deployed position but not secured by the foot bar 29. A plurality of springs 63 can be seen beneath the carriage 33. These are the main springs of the reformer that connect the carriage to a spring mount installed on the interior side of front transverse end 19. For purposes of illustration only, the springs are shown disconnected from the spring mount. The springs 63 may be configured for easy connection and disconnection to the spring mount by manual action. During normal operation of the reformer 20, a user may selectively connect and disconnect any of the springs 63 to achieve different magnitudes of resistant spring force acting against the carriage. This allows a user to increase or decrease the resistant force to best match a user's level of development for a particular exercise. In one embodiment, all of the springs in the set may be identical. In another embodiment, the springs may each provide a different force, for example, in a graduated arrangement. In another embodiment, two or more springs may be identical in a set comprising multiple spring sizes. In another embodiment, the springs may be color-coded for easy identification and association with a particular spring strength.

Figure 9:
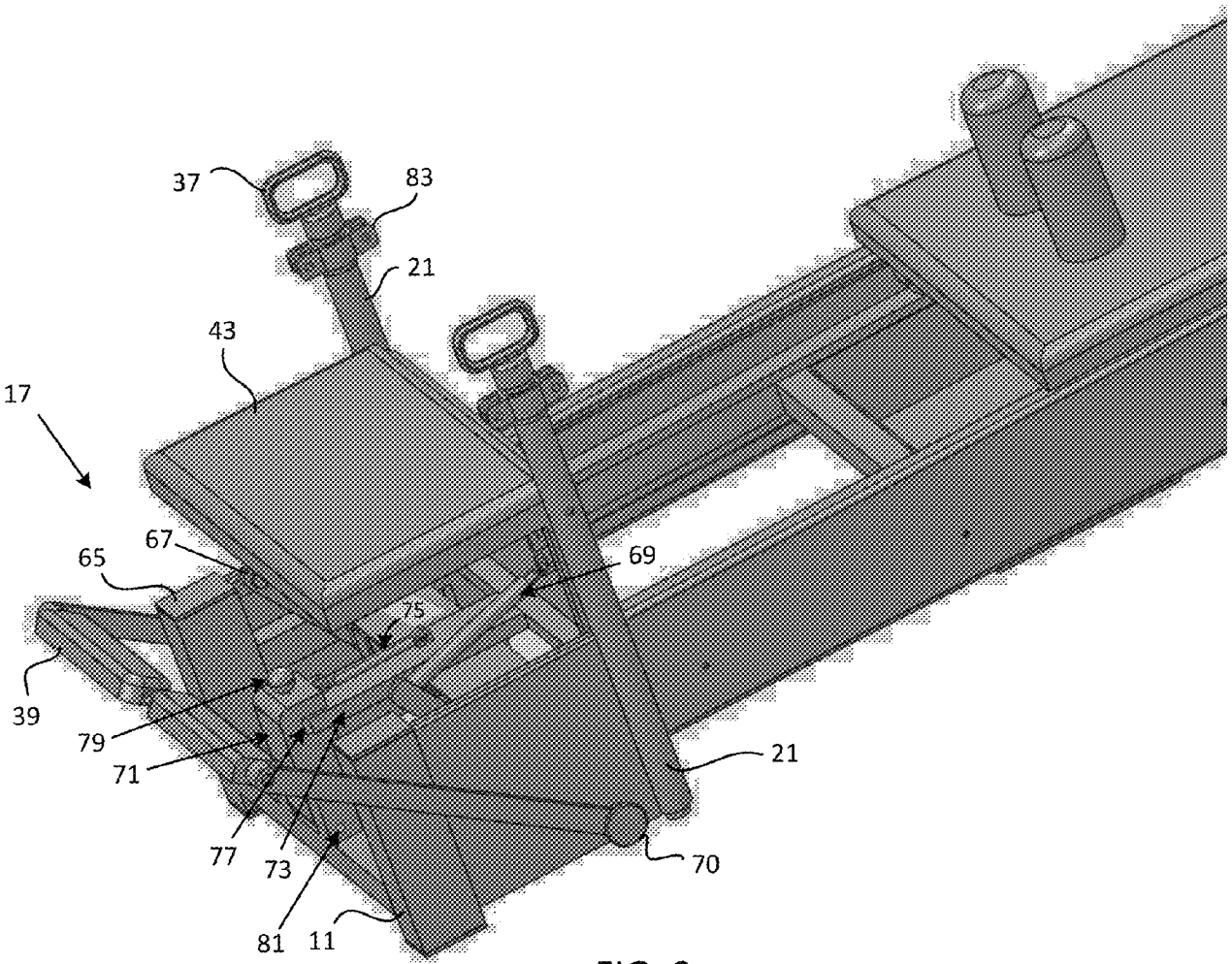
FIG. 9 is a magnified perspective view of the aft end of the reformer of FIG. 2 showing the rotatable bench in a deployed position.

FIG. 9 shows a magnified perspective view of the aft end of the reformer 20. In this view the rotatable bench 43 has been translated to its deployed position to reveal additional structural details. For example, the top surface 65 of each base member 11 of the aft transverse end 17 may be formed from a solid plate, as shown, to provide a placement area for arresting the rotatable bench 43 in the stowed position. A means for rotating the bench, such as hinges 95 (FIG. 19), may be attached underneath the bench. The pinned brackets maintain the bench confined to the frame whether stowed or deployed.

A means for releasably locking the bench in its deployed position may also be provided according to the invention. In one embodiment, the locking means may include a notched pivoting post 71, a locking bar 73, and a tension spring 75. FIG. 9 shows the bench 43 in a deployed and locked position, with the locking bar 73 engaged within the notch 77 of the pivoting post 71. In this condition, an attempt to rotate the bench 43 back to the stowed position will be defeated by the locking means, which will resist the resulting torque imparted to the locking bar. To release the lock, a user may grasp the handle 79 and pull the post 71 away from the locking bar 73 against the restoring force of tension spring 75, until the locking bar disengages from the notch 77. A pivoting mechanism 81 at the base of the pivoting post 71 provides enough rotational freedom to allow the notched end of the post to disengage. In one embodiment, the pivoting mechanism 81 may be formed by pinning the pivoting post 71 to the mounting brackets 23 of the frame 10. A stop (not shown) may be installed to limit the rotational travel of the post 71. When the locking bar has been disengaged from the pivoting post, the bench may be rotated to the stowed position, as the engaging end of the locking bar rides down along the inside surface of the post 71 below the notch. The inside surface of post 71 may be sloped for this purpose.

In some embodiments, the rotatable bench 43 may also be equipped with foot pedals 39 to provide an additional Pilates exercise based on resistance training. In this example, the resistance is provided by two tension springs 69 that each cooperate with a translating arm 67 that is rotatably pinned to the frame 10 at location 70. The tension springs 69 can each be connected to the inner side of the planar surface 45 (FIG. 3) at different connection points to vary the spring tension with the bench in the deployed position, or to accommodate springs of different sizes. When the bench 43 is locked in the deployed position, a user sitting on the bench may exercise by pushing downward on the foot pedals 39. This action rotates levers 72, which are each cooperatively pinned to a translating arm 67 at location 70. In turn, the translating arms 67 rotate downward against the spring force, providing the desired resistance.

FIG. 9 also shows a means 83 for locking the vertically extendable handles 37 to a desired location with respect to the top of the cylindrical tubing 21. Each handle 37 may be connected to an inner shaft 82 (FIG. 7) that rides within cylindrical tubing 21 so that the handle may be pushed or pulled to a desired location. With the handle positioned at a desired location, the locking means 83, for example, a clamp, may be tightened using fastening hardware to fix the inner shaft to the tubing. This function may be achieved by alternative means for locking the handles 37, such as a manually operated push or pull locking mechanism, without departing from the main thrust of the invention.

Figure 10:
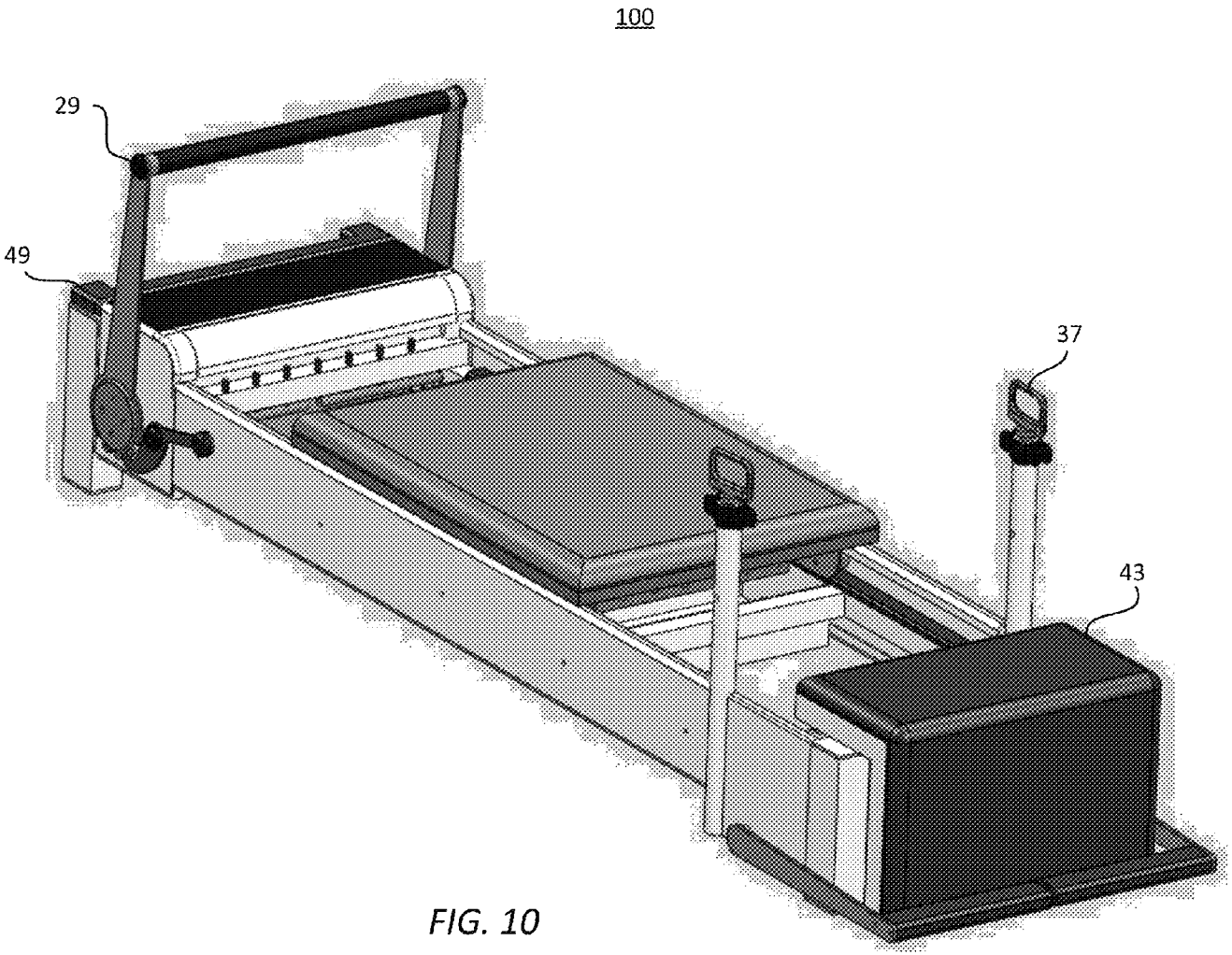
FIG. 10 is an aft end perspective view of another embodiment of a reformer according to the invention showing all purchases—bench, ballet bar, and jump board—in stowed positions.

FIG. 10 shows an aft end perspective view of another embodiment of a reformer 100 according to the invention. This view illustrates one example of the manufacturer's preferred configuration for shipping the reformer and minimizing the size of its shipping container. Accordingly, the ergonomic purchases—bench 43, ballet bar 49, jump board 51, and handles 37—have been translated to their stowed positions. The front foot bar 29 has been locked in an upright position at approximately the same height as the handles. In this configuration, the reformer could be contained within a rectangular box having approximate minimum dimensional of 9.0 ft.×2.5 ft.×2.5 ft. These dimensions are provided as an example only, and may change according to the scale of the reformer.

Figure 11:
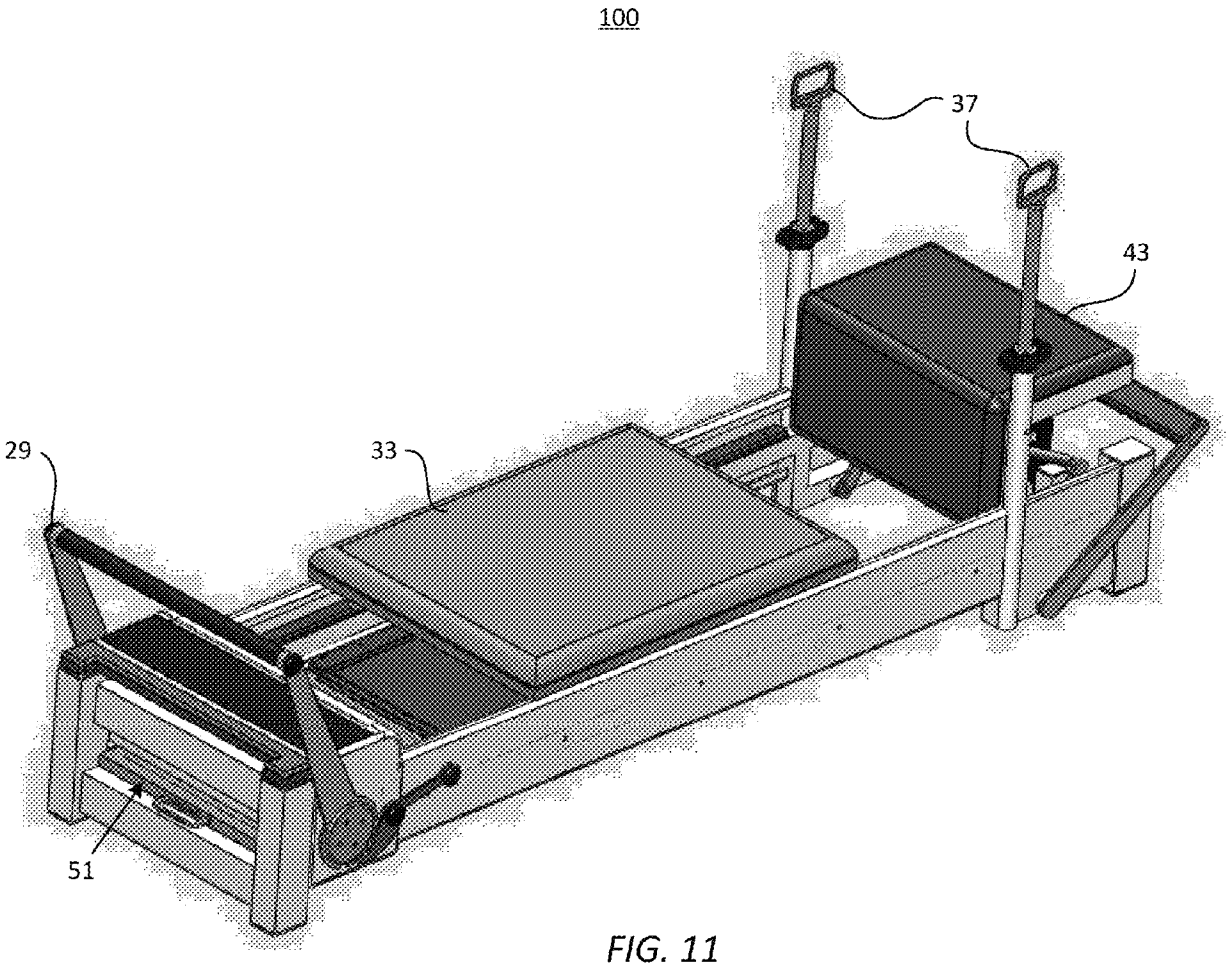
FIG. 11 is a front end perspective view of the reformer of FIG. 10 showing the rotatable bench translated to a deployed position.

FIG. 11 shows a front end perspective view of reformer 100, with the rotating bench 43 and handles 29 translated to their deployed positions. In this reformer, the carriage 33 has a smooth top surface, without shoulder blocks or other top-mounted accessories. In this configuration, while moving the carriage by muscle flexure, a user may find a purchase on the handles 37, a surface of the bench 43, or on the front foot bar 29.

Figure 14:
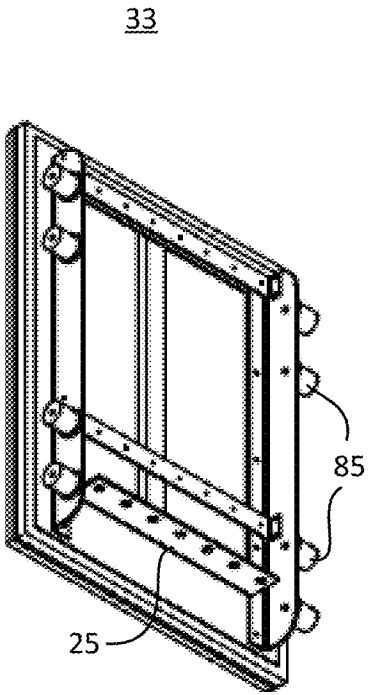
FIG. 14 shows a bottom perspective view of the carriage of FIG. 12.
Figure 13:
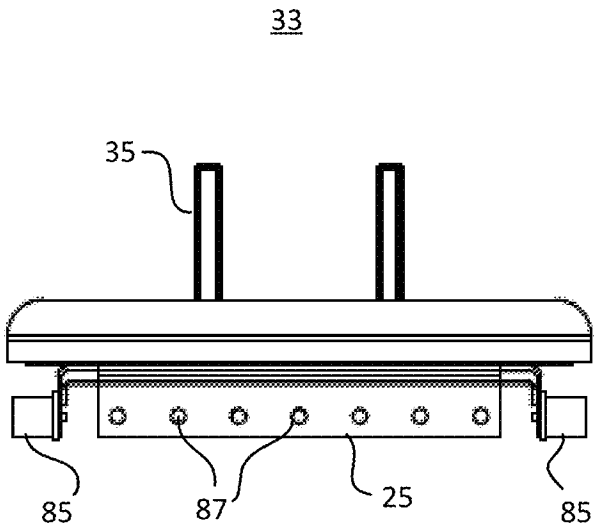
FIG. 13 shows a front end view of the carriage of FIG. 12.
Figure 12:
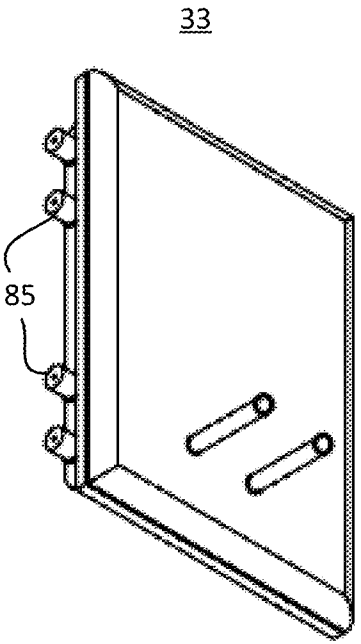
FIG. 12 is a top perspective view of one example of a moveable carriage for mounting to the top of a reformer according to the invention.
Figure 17:
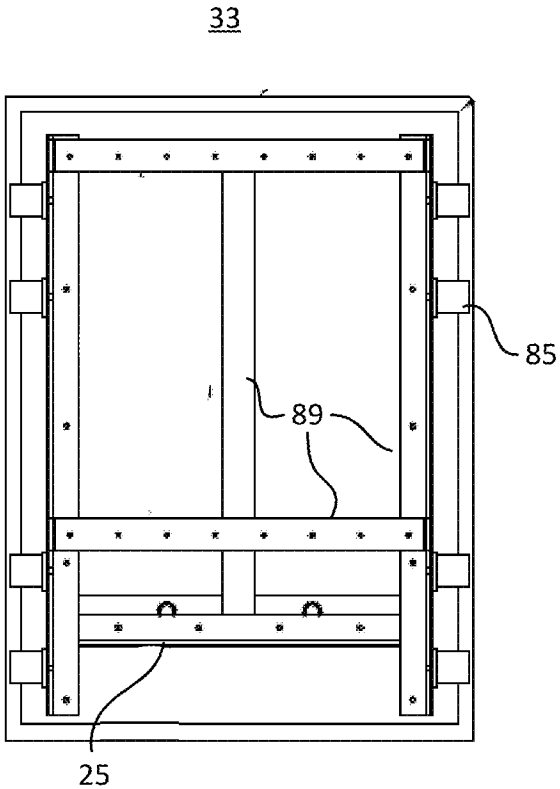
FIGS. 15-17 are top, side, and bottom views, respectively, of the carriage of FIG. 12.
Figure 16:
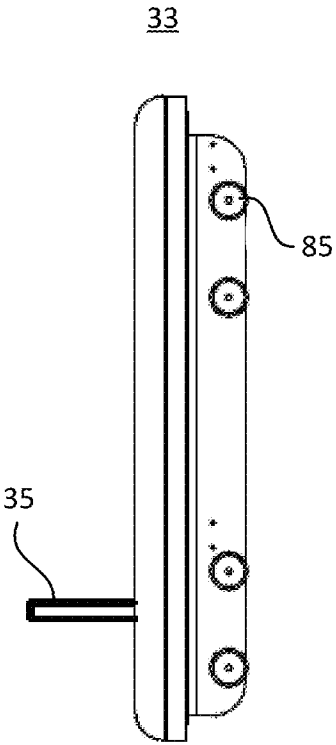
Figure 15:
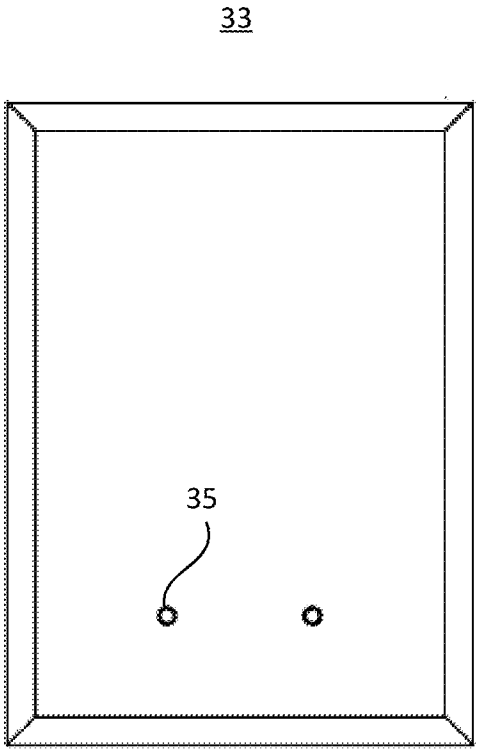

FIGS. 12-17 show various views of one example of a moveable carriage 33 that is slidably mountable to the top part of a reformer according to one embodiment of the invention. FIG. 12 is a top perspective view, showing multiple rollers 85 disposed along one side of the carriage. FIG. 13 shows a front end view of the carriage 33. The spring mount 25, mounted near the front end of the carriage, provides multiple holes 87 for attaching the ends of the main springs. The posts 35 for shoulder blocks are also shown, but without protective padding. FIG. 14 shows a bottom perspective view of the carriage. FIGS. 15, 16, and 17 are top, side, and bottom views, respectively, of the carriage 33. As with most all other parts of the reformer assembly, materials of construction for the carriage may be metal such as carbon or stainless steel, or plastic such as Dupont Delrin. Overall dimensions in one exemplary embodiment are about 40.0 in.×29.0 in. Carriage frame members 89 may be cut, for example, from 1.0 in.×2.0 in. rectangular steel tubing with 0.12 in. thickness.

Figure 18:
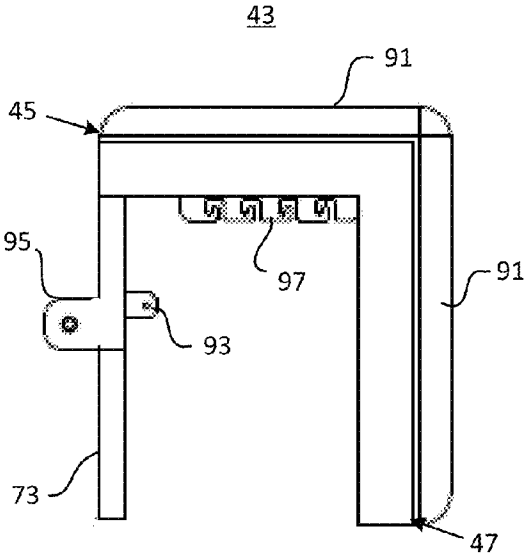
FIG. 18 is a side view of one embodiment of an integral ergonomic purchase according to the invention in the form of a rotating bench.

FIG. 18 shows a side view of one embodiment of an integral ergonomic purchase according to the invention, more specifically, the right-angle rotating bench 43. The bench may be composed of multiple integral metal, wood, or durable plastic parts fastened together, for example, by welding or by conventional fasteners. The overall rectangular dimensions of the first surface 45 may be about 26.0 in.×13.0 in. Those of the second surface may be about 26.0 in.×16.0. These surfaces may be formed from metal plate, such as 0.12 in thick steel, and fastened to a frame constructed from 1.0 in.×2.0 in.×0.12 sections of metal tubing. Specialized parts such as brackets may be machined from similar materials to dimensions commensurate with the drawings. All parts are preferably welded together to achieve the basic configuration shown.

Figure 19:
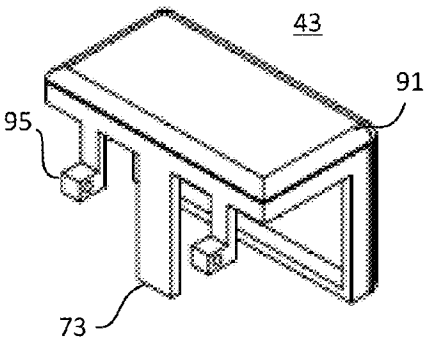
FIGS. 19-21 show various perspective views of the bench of FIG. 18.
Figure 20:
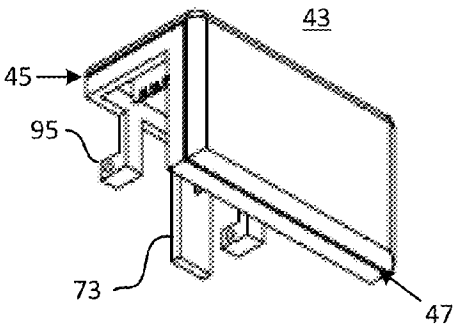
Figure 21:
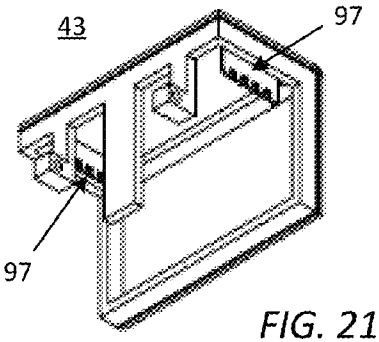

A non-metal part, upholstery 91, may be fastened to surfaces 45 and 47 by an adhesive such as epoxy, or may be a removable elastic fabric. The bench includes a locking bar 73 for engaging the notch 77 of the pivoting post 71 (FIG. 9). The locking bar includes a spring mount 93 for attaching the tension spring 75. Two hinges 95 extend from surface 45 to enable the bench to be rotatably mounted to the frame 10. Spring attachment brackets 97 may be connected beneath the inner side of surface 45. The brackets provides multiple hooks for attaching the tension springs 69 at different connection points to accommodate springs of different sizes or to adjust the spring tension when a user pushes the foot pedals with the bench locked in the deployed position. FIGS. 19-21 show various perspective views of the bench 43.

Figure 23:
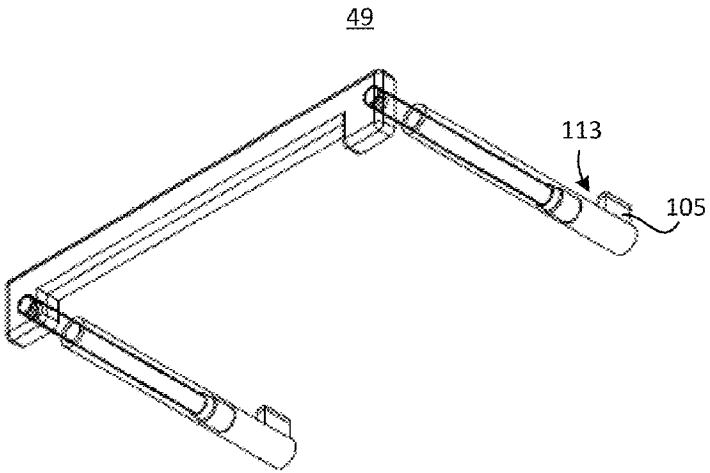
FIG. 23 is a perspective view of the ballet bar of FIG. 22 shown in a retracted state.
Figure 22:
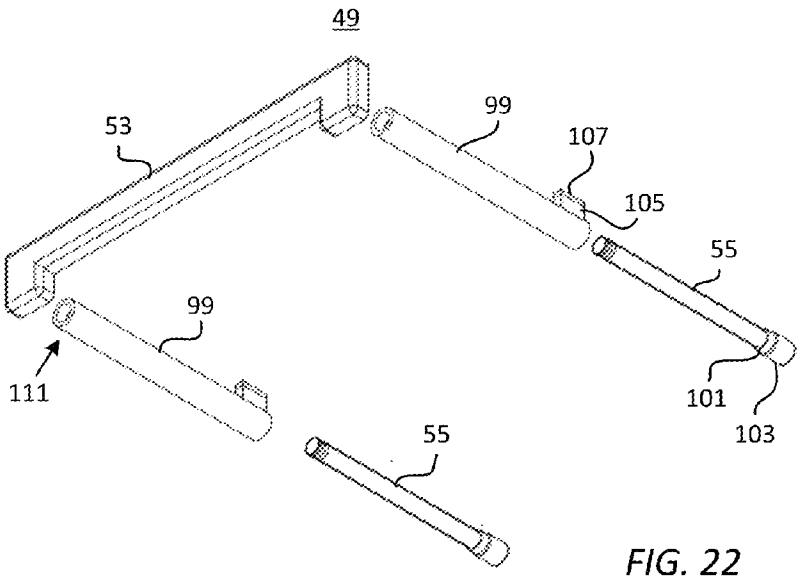
FIG. 22 is an exploded perspective view of one embodiment of an ergonomic purchase according to the invention in the form of a ballet bar.

FIG. 22 shows an exploded perspective view of one embodiment of an ergonomic purchase according to the invention, more specifically, the ballet bar 49. The ballet bar may be composed of five main parts—the horizontal crossbar 53, two upper telescoping arms 55, and two lower telescoping arms 99. When assembled, the upper telescoping arms 55 slide within the lower telescoping arms 99, as shown in FIG. 23, a perspective view of the ballet bar in a retracted state.

Figure 24:
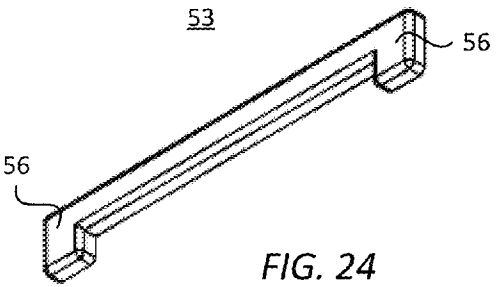
FIG. 24 is a perspective view of a horizontal crossbar for the ballet bar of FIG. 22.

FIG. 24 shows a perspective view of just the horizontal crossbar. Preferably, the crossbar 53 is composed of metal, wood, or a durable plastic such as 0.38 Dupont Delrin. By way of example, the crossbar may be cut or machined from sheet or bar stock to an overall length of about 29.0 in., or another length that is approximately the same width as that of the reformer frame. The width of the crossbar may be about 2.0 to 3.0 in. The thickness may be about 1.25 in. In one embodiment, each end 101 of the crossbar may be widened to provide an anchoring area 56 for one of the upper telescoping arms 55. In the example depicted, the widened area comprises a right-angle rectangular end having dimensions of about 3.0×4.0 in. A threaded hole may be tapped within this area so that an arm 55 may be threadably engaged thereto. A size 1-14 thread about 1.0 in. deep may be suitable for this purpose.

The upper telescoping arm 55 may also be formed from a durable plastic. Delrin tube about 1.0 in. to 1.5 in. diameter may be used for this manufacture. The top end of the arm 55 may be machined to achieve a complimentary threading for engaging a threaded hole of the crossbar 53. Two additional parts may be connected to the bottom of the arm. A powerful round permanent magnet 101, for example, made from ceramic neodymium, having the same or a slightly greater diameter than the arm 101 may be fixed thereto by means of a bushing 103. The bushing may be machined from plastic or metal bar stock. A hole formed through the center of the bushing 103 allows passage of a socket head cap screw (not shown) through the bushing 103 and magnet 101 for engagement within a threaded hole tapped into the lower end of the arm 55. Preferably, the socket head cap screw may be driven into a countersunk portion of the tapped hole so that it becomes flush with the bottom of the bushing when fully engaged. Preferably, the bushing 103 provides the largest diameter along the length of the telescoping arm 55, so that it may arrest the progress of the arm 55 when it reaches the top end of a lower telescoping arm 99.

The lower telescoping arm 99 may be formed, for example, from 1.5 to 2.0 in. seamless carbon steel tubing with a 0.19 in. thickness. A metal or plastic guide bar 105 and a powerful permanent magnet 107 are fixed to the lower end of the arm 99. The guide bar 105 maintains the lower arm 99 within a guide tube 109 as the arm translates vertically. The top end 111 of the lower arm 99 is formed with a reduced diameter, slightly less than the outer diameter of the upper telescoping arm 55.

With the ballet bar 49 in a stowed position, magnets 101 and 107 attract to hold the telescoping arms in fixed relation. A user may overcome this force by pulling upward on the crossbar 53, so that the upper arm 55 slides upward within the lower arm 99 until the bushing 103 reaches the top end 111, where its progress is arrested as it couples to the reduced diameter. A magnetic force may act at this coupling point between magnet 101 and an upper portion of the base member 11. Beyond this point, if the user continues to pull upward, the lower arm 99 by means of the coupling will begin to rise through the guide tube 109. The lower arm will continue to rise until the leading edge 113 of guide bar 105 abuts an interference component (not shown) formed onto the top surface of base member 11. At this point, a magnetic force between magnet 107 and the interference component maintains the ballet bar 49 in the fully deployed position. The magnets 101 and 107 should be selected to have sufficient strength so that a user may use the ballet bar as a balancing aid, i.e., so that the user may exert some amount of downward force on the ballet bar without causing it to retract.

Figure 25:
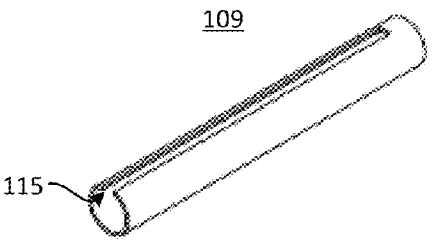
FIG. 25 is a perspective view of one embodiment of a guide tube for guiding a ballet bar of FIG. 22.

FIG. 25 shows a perspective view of the guide tube 109. The guide tube may be installed within a base member 11 to guide the lower telescoping arm 99 as it translates into and out of the base member 11 of frame 10. For this purpose the guide tube 109 may have a slot 115 about 0.5 in. wide formed along most of its length, e.g., about 14 in. along a total guide tube length of about 15 in. The guide bar 105 engages the slot 115 to maintain the arm 99 in proper alignment. Guide tube 109 may also be formed from steel and welded directly to the inside of the base member 11.

FIG. 26 shows a top view of one embodiment of an ergonomic purchase, more specifically, a slidable and rotatable jump board 51 hinged to a sliding guide 52 according to the invention. This assembly may further include a hinge 117 configured to allow about 180 degrees of rotation of the jump board 51 with respect to the sliding guide 52. In one embodiment, the jump board may be constructed from metal plate covering and welded to a rectangular frame, to achieve overall rectangular dimensions of about 22.5 in.×26.0 in. The frame may be constructed from 1.0 in. square steel tubing having a 0.06 in. wall thickness. The jump board 51 may also include a handle 119 for ease of manipulation. The jump board may also be upholstered or fitted with a rubber mat. FIG. 27 shows a front end view of the jump board 51.

FIG. 28 shows a magnified top view of sliding guide 52. The sliding guide may be formed from a single metal plate approximately 0.19 in. thick with overall dimensions of 22.5 in.×12.75 in. At its aft end, the plate may be bent to form a right angle stop 121. The stop limits the travel of the jump board as it is drawn out from beneath the carriage 33 by abutting a complimentary stop member (not shown) attached to front transverse end 17 of the frame 10. In this way, the jump board may be confined to the reformer.

The sliding guide 52 may also include two guide wings 123, each configured with an optional stopping edge 125. The guide wings are preferably formed from a durable Delrin plastic. The guide wings are configured with runners 127 that dip below the sliding guide plate to act as a bearing surface for sliding along guide rails or longitudinal members of the frame 10 as the jump board translates. Stopping edges 125 may limit the travel of the jump board as an alternative to the right angle stop 121. FIG. 29 shows a side view of the sliding guide and wings.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. In a reformer having a rectangular frame and a planar carriage attached to the frame by springs, the carriage moveable horizontally against force of the springs by means of rollers along longitudinal rails mounted to the frame, the improvement comprising:

an ergonomic purchase integral to the reformer and translatable into deployed and stowed positions;

wherein the ergonomic purchase comprises a rotatable bench rotatably confined to one end of the reformer.

2. The reformer of claim 1 wherein the rotatable bench further comprises a first planar surface; and a second planar surface forming a right angle with respect to the first planar surface;

wherein when the bench is translated by rotation to the stowed position, the first planar surface lies substantially within a plane parallel to the carriage at a first elevation; and wherein when the bench is translated by rotation to the deployed position, the first planar surface lies substantially within a plane normal to the carriage and the second planar surface lies substantially in a plane parallel to the carriage at a second elevation.

3. The reformer of claim 2 wherein the carriage lies substantially within a plane located at one of the first and second elevations.

4. The reformer of claim 2 wherein the bench in the deployed position enables a user mounted on the carriage to reach the first planar surface for a purchase.

5. In a reformer having a rectangular frame and a planar carriage attached to the frame by springs, the carriage moveable horizontally against force of the springs by means of rollers along longitudinal rails mounted to the frame, the improvement comprising:

an ergonomic purchase integral to the reformer and translatable into deployed and stowed positions, the ergonomic purchase comprising a vertically adjustable ballet bar confined at one end of the reformer;

wherein the ballet bar further comprises a substantially horizontal crossbar vertically supported by telescoping arms;

wherein when the ballet bar is translated to the stowed position, the telescoping arms are retracted within the frame to lower the crossbar to an elevation substantially level with the carriage; and wherein when the ballet bar is translated to the deployed position, the telescoping arms are extended beyond the frame to raise the crossbar to an elevation substantially higher than the carriage.

6. In a reformer having a rectangular frame and a planar carriage attached to the frame by springs, the carriage moveable horizontally against force of the springs by means of rollers along longitudinal rails mounted to the frame, the improvement comprising:

an ergonomic purchase integral to the reformer and translatable into deployed and stowed positions;

wherein the ergonomic purchase comprises a slidable and rotatable jump board confined to one end of the reformer, and a sliding guide hinged to the slidable and rotatable jump board;

wherein when the jump board is translated to the stowed position, the jump board and sliding guide lie substantially within a common plane; and wherein when the jump board is translated to the deployed position, the jump board forms an angle greater than zero with respect to the sliding guide.

7. The reformer of claim 6 configured so that translation of the ergonomic purchase from the stowed to the deployed position requires sliding the jump board beyond the end of the reformer and rotating the jump board with respect to the sliding guide and toward the end of the reformer.

8. The reformer of claim 7 further comprising:

a horizontal foot bar supported by lever arms rotatably pinned to the longitudinal rails so that the foot bar is rotatable about an axis transverse to the frame; and a locking mechanism releasably locking the lever arms at a variable rotational angle with respect to the longitudinal rails;

thereby enabling securement of the jump board in the deployed position by locking the lever arms at an angle that arrests the jump board between the foot bar and the end of the reformer.

9. The reformer of claim 6 wherein the jump board in the deployed position enables a user mounted on the carriage to reach the jump board for a purchase.

10. In a reformer having a rectangular frame and a planar carriage attached to the frame by springs, the carriage moveable horizontally against force of the springs by means of rollers along longitudinal rails mounted to the frame, the improvement comprising:

an ergonomic purchase integral to the reformer and translatable into deployed and stowed positions;

wherein the ergonomic purchase comprises a slidable and rotatable jump board confined to one end of the reformer, and wherein the ergonomic purchase in the stowed position lies at least partially beneath the carriage.

11. A reformer comprising:

a rectangular frame having two transverse ends connected by longitudinal rails, each transverse end comprising a pair of bases and a transverse member connected therebetween;

a planar carriage attached to the frame by springs, the carriage moveable horizontally against force of the springs by means of rollers along the longitudinal rails; and an ergonomic purchase confined to the frame and translatable into a stowed position for spatial efficiency, and into a deployed position that enables a user mounted on the carriage to reach the purchase;

wherein a transverse end arrests the ergonomic purchase in the stowed or deployed position.

12. The reformer of claim 11 wherein the ergonomic purchase comprises a rotatable bench arrested in the stowed position by one of the transverse ends.

13. The reformer of claim 11 wherein the ergonomic purchase comprises a slidable and rotatable jump board arrested in the deployed position by one of the transverse ends, and supported in the stowed position by the one transverse end.

14. The reformer of claim 11 wherein the ergonomic purchase comprises a vertically adjustable ballet bar, the ballet bar in the deployed position supported by one of the transverse ends, and the ballet bar in the stowed position at least partially retracted within the one transverse end.

15. A reformer comprising:

a rectangular frame and a planar carriage attached to the frame by springs, the frame having a transverse end comprising a base pair and connecting transverse member, the carriage moveable horizontally against force of the springs by means of rollers along longitudinal rails mounted to the frame;

one or more ergonomic purchases integral to the reformer; and means for translating the ergonomic purchase into deployed and stowed positions so that the ergonomic purchase is arrested by the transverse end in the deployed or stowed position.

16. The reformer of claim 15 wherein the one or more ergonomic purchases are selected from the group consisting of a rotatable bench, a slidable and rotatable jump board, and a vertically adjustable ballet bar.

* * * * *